US009406994B2

(12) United States Patent
Carley et al.

(10) Patent No.: US 9,406,994 B2
(45) **Date of Patent: *Aug. 2, 2016**

(54) REMOTE ANTENNA DEPLOYMENT LATCH

(71) Applicant: Raytheon Company, Waltham, MA (US)

(72) Inventors: Ryan William Carley, Milforn, MA (US); Michael Mcfeeters, Wilmington, MA (US); Joseph A. Frassa, Billerica, MA (US); Timothy R. Hebert, Clinton, MA (US)

(73) Assignee: Raytheon Company, Waltham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/666,041

(22) Filed: Mar. 23, 2015

(65) Prior Publication Data

US 2015/0194721 A1 Jul. 9, 2015

Related U.S. Application Data

(63) Continuation of application No. 13/797,398, filed on Mar. 12, 2013, now Pat. No. 8,988,307.

(51) Int. Cl.

| | |
|---|---|
| ***H01Q 1/08*** | (2006.01) |
| ***H01Q 1/12*** | (2006.01) |
| ***H01Q 1/32*** | (2006.01) |
| ***H01Q 3/04*** | (2006.01) |
| ***H01Q 3/08*** | (2006.01) |
| ***H01Q 3/00*** | (2006.01) |

(52) U.S. Cl.

CPC ..... *H01Q 1/084* (2013.01); *H01Q 1/125* (2013.01); *H01Q 1/1235* (2013.01); *H01Q 1/1264* (2013.01); *H01Q 1/3275* (2013.01); *H01Q 3/005* (2013.01); *H01Q 3/04* (2013.01); *H01Q 3/08* (2013.01); *Y10T 403/593* (2015.01)

(58) Field of Classification Search

None

See application file for complete search history.

(56) References Cited

U.S. PATENT DOCUMENTS

| | | | | |
|---|---|---|---|---|
| 2,877,459 | A * | 3/1959 | Brown et al. | 343/757 |
| 3,747,113 | A | 7/1973 | De Vellis | |
| 4,226,138 | A | 10/1980 | Ha-Pham | |
| 4,771,293 | A * | 9/1988 | Williams et al. | 343/757 |
| 4,916,964 | A | 4/1990 | Crack | |
| 5,528,250 | A | 6/1996 | Sherwood et al. | |
| 5,576,722 | A | 11/1996 | Bustillos | |
| 5,646,638 | A | 7/1997 | Winrgard et al. | |
| 6,977,618 | B1 | 12/2005 | Hanewinkel et al. | |
| 8,988,307 | B2 * | 3/2015 | Carley et al. | 343/880 |
| 2007/0205338 | A1 | 9/2007 | Sabatino | |
| 2012/0251092 | A1 * | 10/2012 | Zwaan et al. | 396/428 |

FOREIGN PATENT DOCUMENTS

| | | | |
|---|---|---|---|
| EP | 0285299 | A2 | 10/1988 |
| EP | 0285299 | B1 | 10/1988 |
| WO | WO 2014/165220 | A1 | 10/2014 |

* cited by examiner

*Primary Examiner* — Robert Karacsony

(57) ABSTRACT

A remote antenna deployment latch is disclosed. The remote antenna deployment latch includes a latch assembly having a latch pin movable to alternately secure an antenna in, and release the antenna from, a deployed position. The remote antenna deployment latch also includes an azimuth pin movable to alternately lock and unlock rotation of the antenna about an azimuth axis. In addition, the remote antenna deployment latch includes a remote control assembly operably coupled to the latch pin and the azimuth pin to simultaneously secure the antenna in the deployed position and unlock rotation of the antenna about the azimuth axis.

23 Claims, 6 Drawing Sheets

REMOTE ANTENNA DEPLOYMENT LATCH

RELATED APPLICATIONS

This is a continuation application of U.S. application Ser. No. 13/797,398, filed Mar. 12, 2013, entitled "Remote Antenna Deployment Latch," which is incorporated by reference in its entirety herein.

BACKGROUND

Antenna designs encompass a wide range of configurations and are used for a variety of different applications. For example, some antennas are designed for use at a fixed elevation angle and for rotation to a desired azimuth. Such antennas may be deployable from a stowed position or configuration to a deployed position in which the antennas are oriented at the fixed elevation or operating angle. Typically, an antenna is maintained at its operating angle by the means in which it was deployed or moved from its stowed position. However, in some cases, the means for deploying an antenna are not sufficient to maintain the antenna at the operating angle. Typically, various types of latches have been implemented to lock antennas in the operating angles once deployed.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
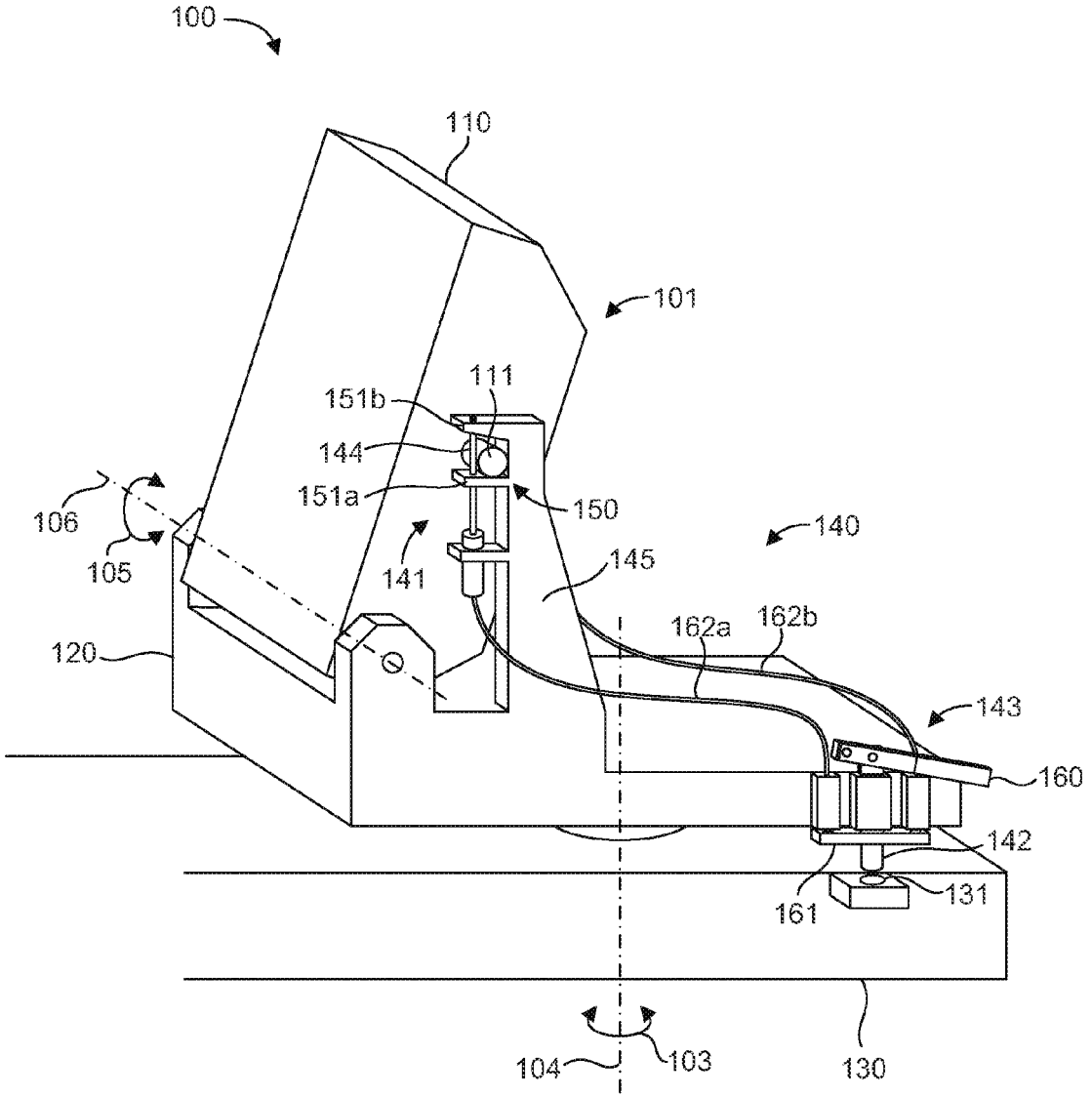
FIG. 1 is an example illustration of a deployable antenna system having a remote antenna deployment latch in accordance with an embodiment of the present invention.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

Although typical antenna latches have been effective in locking and maintaining antennas at the operating elevation angles when deployed, the locations of the latches are not readily accessible by antenna operators. Additionally, operators may need to unlock the antenna for movement to a desired azimuth once the antenna has been deployed. Thus, typical antenna latch designs can hinder operator convenience and speed, as well as present safety concerns, in order for the operator to prepare an antenna for use.

Accordingly, a remote antenna deployment latch is disclosed that allows an antenna operator to operate a latch locking the antenna in an operating elevation angle as well as unlocking the antenna for movement to a desired azimuth during operation. The remote antenna deployment latch can include a latch assembly having a latch pin movable to alternately secure an antenna in, and release the antenna from, a deployed position. The remote antenna deployment latch can also include an azimuth pin movable to alternately lock and unlock rotation of the antenna about an azimuth axis. In addition, the remote antenna deployment latch can include a remote control assembly operably coupled to the latch pin and the azimuth pin to simultaneously secure the antenna in the deployed position and unlock rotation of the antenna about the azimuth axis.

In one aspect, a deployable antenna system is disclosed. The deployable antenna system can include an antenna movable between a stowed position and 5*a* deployed position, and rotatable about an azimuth axis, and a remote antenna deployment latch. The remote antenna deployment latch can comprise a latch assembly having a latch pin movable to alternately secure the antenna in, and release the antenna from, the deployed position. The remote antenna deployment latch can also comprise an azimuth pin movable to alternately lock and unlock rotation of the antenna about the azimuth axis. Additionally, the remote antenna deployment latch can comprise a remote control assembly operably coupled to the latch pin and the azimuth pin to simultaneously secure the antenna in the deployed position and unlock rotation of the antenna about the azimuth axis.

One embodiment of a deployable antenna system 100 is illustrated in FIG. 1. The deployable antenna system 100 can comprise an antenna 110 supported by a platform 120 that is movable relative to a base 130. The base 130 can be at a permanently fixed location or configured for mobility, such as on a truck or a trailer. With the antenna 110 in the deployed position 101 illustrated in FIG. 1, the platform 120 can rotate in direction 103 about azimuth axis 104 to facilitate operation of the antenna 110. As discussed further hereinafter, the antenna 110 can be moved to a stowed position. For example the antenna 110 can be rotatably coupled to the platform 120 for movement in direction 105 about a deployment axis 106 between stowed and deployed positions.

The deployable antenna system 100 can also include a remote antenna deployment latch 140 having a latch assembly 141, an azimuth pin 142, and a remote control assembly 143. The latch assembly 141 can include a latch pin 144 movable to alternately secure the antenna 110 in, and release the antenna from, the deployed position 101. The azimuth pin 142 can be movable to alternately lock and unlock rotation of the antenna 110 about the azimuth axis 104 by interfacing with the base 130, such as via an opening 131. The remote control assembly 143 can be operably coupled to the latch pin 144 and the azimuth pin 142 to simultaneously secure the antenna 110 in the deployed position 101 and unlock rotation of the antenna 110 about the azimuth axis 104. In one aspect, the remote control assembly 143 can simultaneously release the antenna 110 from the deployed position 101 and lock rotation of the antenna 110 about the azimuth axis 104.

The latch assembly 141 can be supported by a latch support arm 145 supported by the movable platform 120. The latch assembly 141 can include a hard stop 150 configured to interface with an antenna latching feature 111 and establish the deployed position 101 of the antenna 110. The latch assembly 141 can include one or more latch pin support members 151*a*, 151*b* to position the latch pin 144 relative to the hard stop 150. The position of the latch pin 144 relative to the hard stop 150 can facilitate contact with the antenna latching feature 111 when the latch pin 144 secures the antenna 110 in the deployed position 101. Contacting the antenna latching feature 111 with both the hard stop 150 and the latch pin 144 can form a coupling that has improved stiffness over mere contact between the antenna latching feature 111 and the hard stop 150. One benefit of a high stiffness coupling is improved antenna pointing accuracy, which can improve antenna performance for high frequency applications.

In one aspect, the remote control assembly 143 can be supported by the movable platform 120. In some embodiments, the remote control assembly 143 can be mechanically coupled to the latch pin 144 and the azimuth pin 142. The remote control assembly 143 can have a lever 160 configured to cause movement of the latch pin 144 and the azimuth pin 142. For example, the lever 160 can cause movement of a yoke 161 coupled to the latch pin 144 and the azimuth pin 142. The yoke 161 can mechanically move the latch pin 144 via a push-pull cable 162*a*. In one aspect, the yoke 161 can also mechanically move a second latch pin located on an opposite side of the antenna 110 via push-pull cable 162*b*. By including a second latch pin in contact with a second antenna latching feature on the opposite side of the antenna 110, stiffness of the antenna couplings in the deployed position can be improved over using only a single latch pin. Thus, in some embodiments, the remote control assembly 143 can remotely move multiple latch pins at once for securing or releasing the antenna. Although no springs are shown, it should be recognized that some embodiments can incorporate one or more springs tending to bias movement of the latch pin 144 and/or the azimuth pin 142.

In addition, the yoke 161 can mechanically move the azimuth pin 142. Thus, as the yoke 161 moves, one or more latch pins 144 can be caused to move, as well as the azimuth pin 142. In some embodiments, the yoke 161 can be hydraulically or pneumatically coupled to the latch pin 144 and/or the azimuth pin 142 such that movement of the yoke operates a piston to hydraulically or pneumatically move the latch pin 144 and/or the azimuth pin 142. Additionally, some embodiments can combine mechanical, hydraulic, and/or pneumatic couplings between the yoke 161 and the latch pin 144 and/or the azimuth pin 142 in order to cause movement of the latch pin 144 and/or the azimuth pin 142 in response to movement by the yoke 161. The common connection between the yoke 161, the latch pins 144, and the azimuth pin 142 can therefore facilitate simultaneous operation of the latch pins 144 and the azimuth pin 142. The lever 160 can comprise any suitable type of lever for moving the yoke 161. In some aspects, the lever 160 comprises a toggle lever, an over cam lever, an over center lever, or any other lever operable to move between two positions and cause linear movement of the yoke 161. With such a lever 160, the latch pin 144 and the azimuth pin 142 can be caused to move fully between latched/unlatched positions and unlocked/locked positions, respectively.

Figure 2:
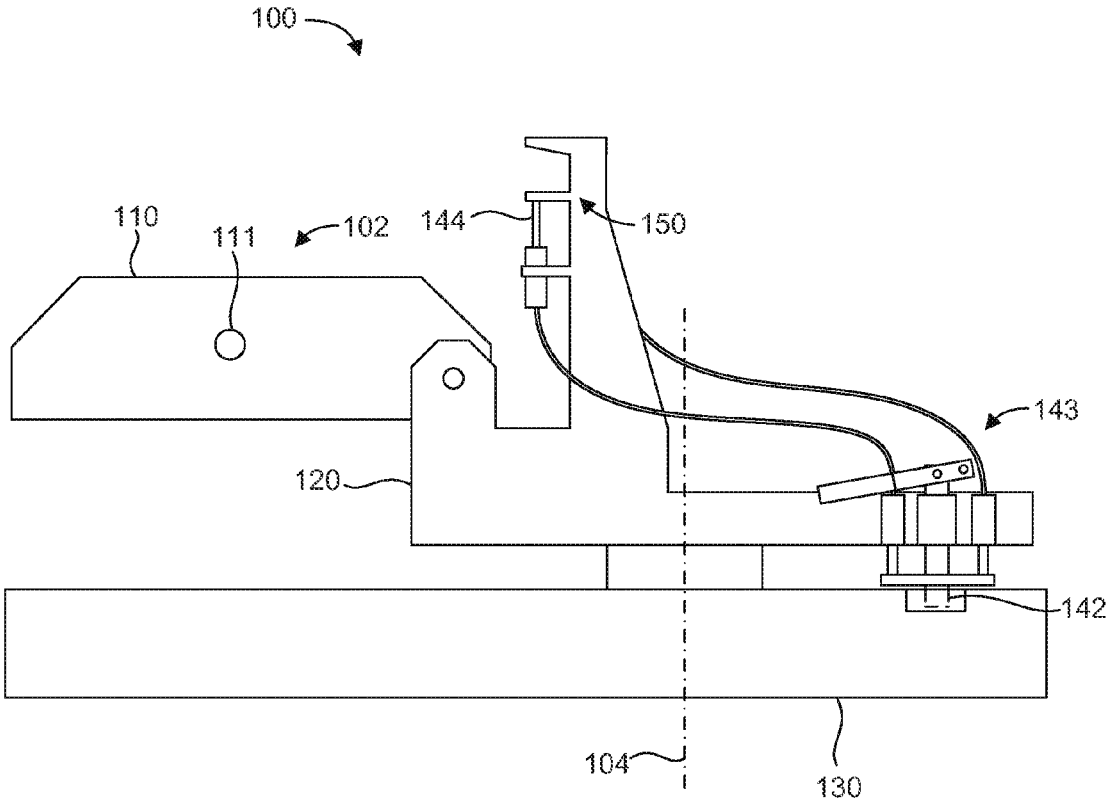
FIG. 2 is side view of the deployable antenna system of FIG. 1, with an antenna in a stowed configuration.
Figure 3:
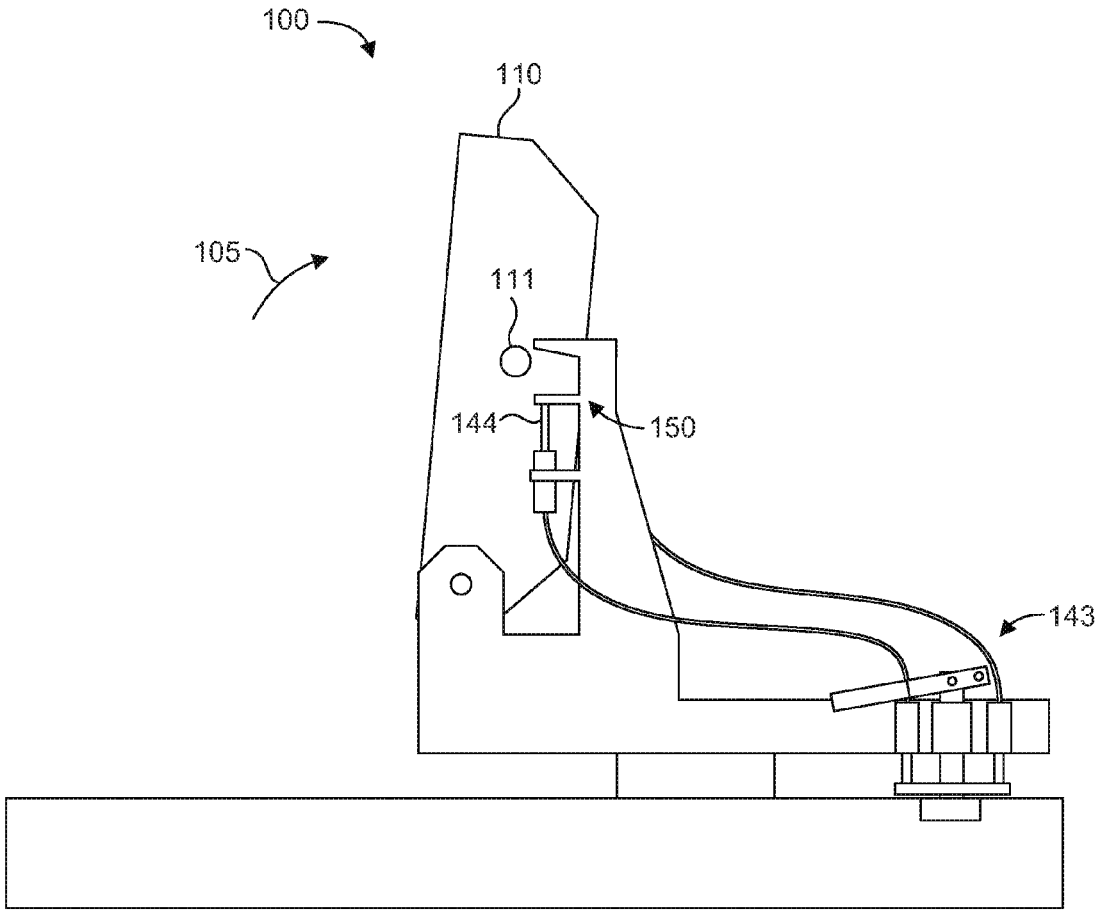
FIG. 3 is side view of the deployable antenna system of FIG. 1, with the antenna moving between the stowed position and a deployed position.
Figure 4:
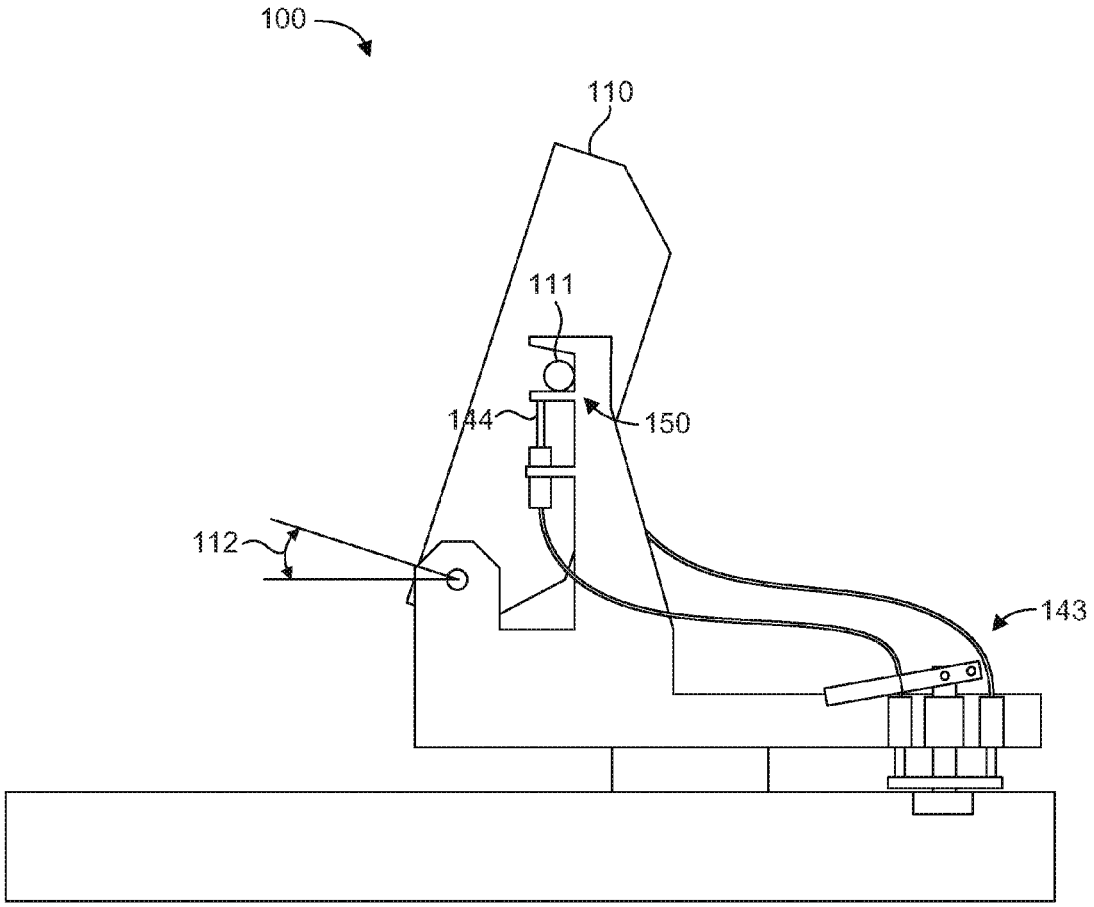
FIG. 4 is side view of the deployable antenna system of FIG. 1, with the antenna in the deployed position prior to securing the antenna and unlocking movement about an azimuth axis.
Figure 5:
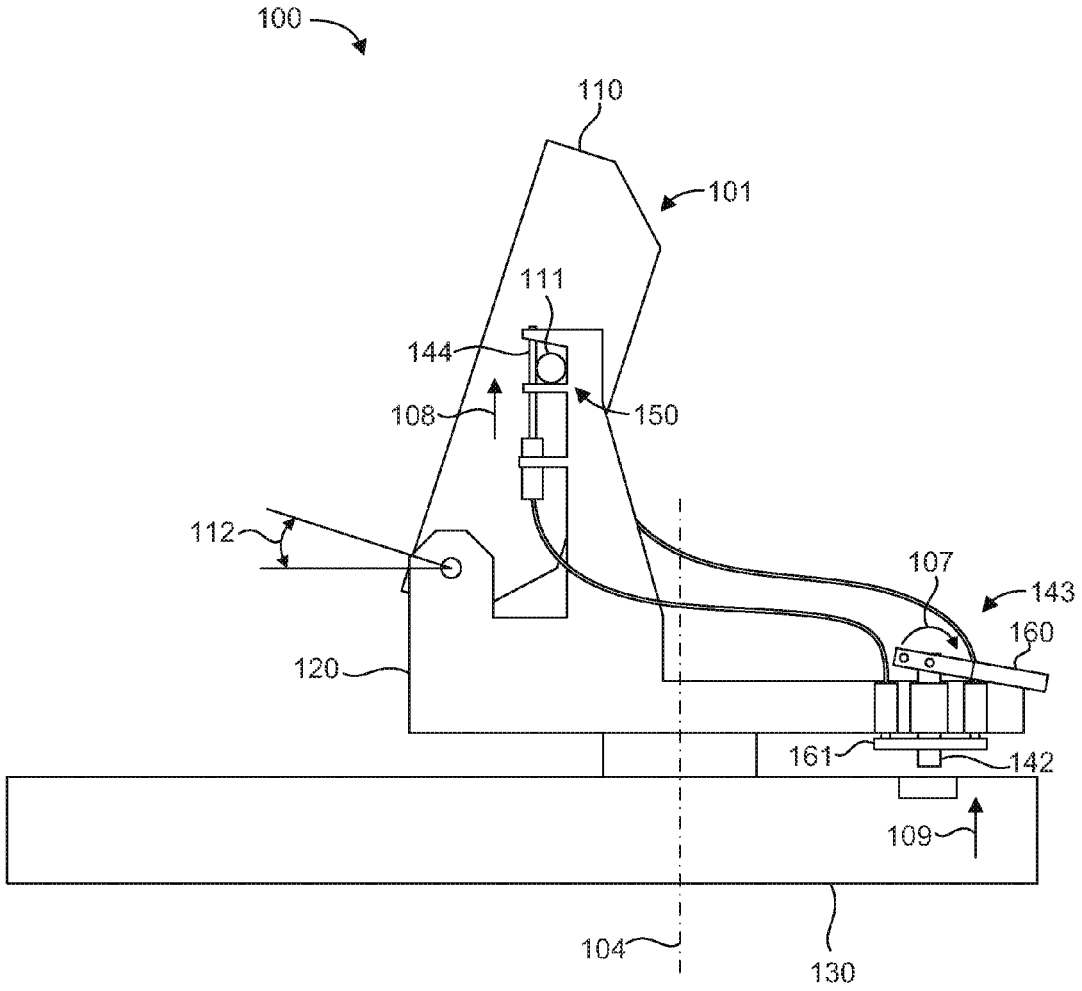
FIG. 5 is side view of the deployable antenna system of FIG. 1, with the antenna secured in the deployed position and free to move about the azimuth axis.

FIGS. 2-5 illustrate the deployable antenna system 100 in operation. For example, FIG. 2 illustrates the antenna 110 in a stowed position 102. With the antenna 110 in the stowed position 102, the remote control assembly 143 can be configured such that the azimuth pin 142 is engaged with the base 130 to lock the platform 120 in a fixed position relative to the base 130 to prevent relative movement of the platform 120 about the azimuth axis 104. In addition, the remote control assembly 143 can be configured such that the latch pin 144 is positioned to allow the antenna latching feature 111 to rotate with the antenna 110 in direction 105 into contact with the hard stop 150 to position the antenna at a predetermined operation elevation angle 112, as illustrated in FIGS. 3 and 4. As shown in FIG. 5, once the antenna latching feature 111 has contacted the hard stop 150 and positioned the antenna at the operational angle 112, the remote control assembly 143 can be operated, such as by moving lever 160 in direction 107, to cause the latch pin 144 to move in direction 108 to secure the antenna latching feature 111 and, thus, the antenna 110 in the deployed position 101. Because the azimuth pin 142 and the latch pin 144 are both coupled to the yoke 161, the operation of the remote control assembly 143 can simultaneously cause the azimuth pin 142 to move in direction 109 to unlock relative movement of the movable platform 120 and the base 130 about the azimuth axis 104. The location of the remote control assembly 143 can facilitate ease of use by an operator and improve safety in that the operator can secure the antenna 110 in the deployed position 101 and unlock rotation about the azimuth axis 104 without the necessity of climbing onto the base 130 or movable platform 120. With the antenna 110 locked in the deployed position 101 and the movable platform 120 supporting the antenna 110 free to rotate about the azimuth axis 104, the antenna 110 can be operated. In some embodiments, the remote antenna deployment latch 140 can include purely mechanical structures or systems for remotely operating the latch. In other embodiments, the remote antenna deployment latch 140 can include mechanical, hydraulic, and/or pneumatic structures and systems for remotely operating the latch.

It should be recognized that the antenna 110 can be moved from the deployed position 101 to the stowed position 102 by reversing the order of the operations discussed above with respect to FIGS. 2-5. For example, operation of the remote control assembly 143 can simultaneously lock the movable platform 120 relative to the base 130 and release the antenna 110 from the deployed position 101 for movement to the stowed position 102. This can prevent the antenna 110 from rotating freely about the azimuth axis 104 as the antenna 110 moves between the deployed position 101 and the stowed position 102, which can provide a safety benefit. For example, uncontrolled rotation of the movable platform 120 can occur when the antenna 110 is between the deployed and stowed positions 101, 102, such as at a low elevation angle, and the movable platform 120 is not leveled. Such uncontrolled antenna 110 rotation can cause the base 130, such as a trailer or vehicle, to tip over, or allow the antenna 110 to strike someone standing close by.

Figure 6:
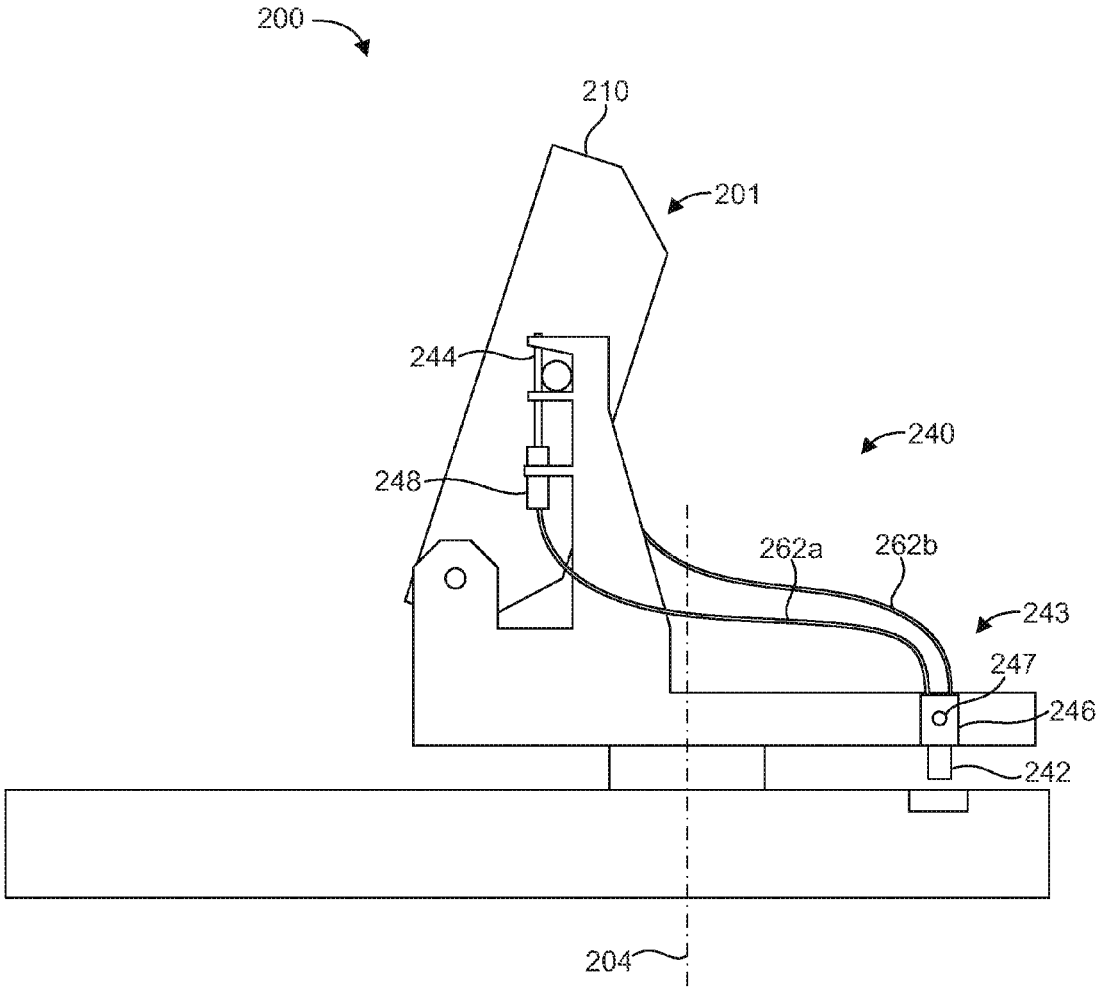
FIG. 6 is an example illustration of a deployable antenna system having a remote antenna deployment latch in accordance with another embodiment of the present invention.

As shown in FIG. 6, a deployable antenna system 200 is illustrated having a remote antenna deployment latch 240 that can include electrical and/or mechanical, hydraulic, and pneumatic structures and systems for remotely operating the latch. For example, remote control assembly 243 can include an electric motor 247 and a switch 247 for operating the motor 247. The motor 247 can cause movement of an azimuth pin 242 to lock/unlock rotation about the azimuth axis 204. In one aspect, the switch 247 can also be electrically coupled via lines 262*a*, 262*b* to one or more electric motors 248 operable to cause movement of one or more latch pins 244 to secure/release an antenna 210 in a deployed position 201. The electric motors 246, 247 can cause the respective azimuth pin 242 and latch pin 244 to move via gears, hydraulics, pneumatics, or any other suitable means. In some embodiments, the electric motor 246 can hydraulically or pneumatically cause motion of one or more latch pins 244 by pressurizing lines 262*a*, 262*b*. The remote antenna deployment latch 240 can therefore function to move the azimuth pin 242 and the latch pin 244 to simultaneously secure the antenna 210 in the deployed position 201 and unlock movement of the antenna 210 about the azimuth axis 204.

In accordance with one embodiment of the present invention, a method for facilitating use of a deployable antenna is disclosed. The method can comprise providing a latch assembly having a latch pin movable to alternately secure an antenna in, and release the antenna from, a deployed position. The method can also comprise providing an azimuth pin movable to alternately lock and unlock rotation of the antenna about an azimuth axis. Additionally, the method can comprise facilitating simultaneous operation of the latch pin and the azimuth pin, wherein the antenna is secured in the deployed position and rotation of the antenna about the azimuth axis is unlocked. It is noted that no specific order is required in this method, though generally in one embodiment, these method steps can be carried out sequentially.

In one aspect, the method can further comprise facilitating simultaneous operation of the latch pin and the azimuth pin comprises operably coupling a remote control assembly to the latch pin and the azimuth pin. In another aspect, the remote control assembly can comprise a lever operably coupled to a yoke, wherein the yoke mechanically moves the azimuth pin and is coupled to a push-pull cable to mechanically move the latch pin.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A remote device deployment latch, comprising:

a latch assembly having a latch pin movable to alternately secure a device in, and release the device from, a deployed position;

an azimuth pin movable to alternately lock and unlock rotation of the device about an azimuth axis; and a control assembly operably coupled to the latch pin and the azimuth pin to secure/release the device in/from the deployed position and lock/unlock rotation of the device about the azimuth axis.

2. The remote device deployment latch of claim 1, wherein the control assembly is operably coupled to the latch pin and the azimuth pin such that the control assembly simultaneously secures the device in the deployed position and unlocks the rotation of the device about the azimuth axis.

3. The remote device deployment latch of claim 1, wherein the control assembly is operably coupled to the latch pin and the azimuth pin such that the control assembly simultaneously releases the device from the deployed position and locks rotation of the device about the azimuth axis.

4. The remote device deployment latch of claim 1, wherein the latch assembly comprises a hard stop configured to interface with a device latching feature and establish the deployed position of the device.

5. The remote device deployment latch of claim 4, wherein the latch assembly comprises a latch pin support member to position the latch pin relative to the hard stop.

6. The remote device deployment latch of claim 5, wherein the position of the latch pin relative to the hard stop facilitates contact with the device latching feature when the latch pin secures the device in the deployed position.

7. The remote device deployment latch of claim 1, wherein the control assembly comprises a lever configured to cause movement of the latch pin.

8. The remote device deployment latch of claim 7, wherein the lever causes movement of a yoke coupled to the latch pin and the azimuth pin.

9. The remote device deployment latch of claim 8, wherein the yoke mechanically moves the azimuth pin.

10. The remote device deployment latch of claim 8, wherein the yoke mechanically moves the latch pin via a push-pull cable.

11. The remote device deployment latch of claim 7, wherein the lever comprises a toggle lever.

12. A deployable device system, comprising:

an device movable between a stowed position and a deployed position, and rotatable about an azimuth axis; and a remote device deployment latch comprising:

a latch assembly having a latch pin movable to alternately secure the device in, and release the device from, the deployed position, an azimuth pin movable to alternately lock and unlock rotation of the device about the azimuth axis, and a control assembly operably coupled to the latch pin and the azimuth pin to secure/release the device in/from the deployed position and lock/unlock rotation of the device about the azimuth axis.

13. The system of claim 12, wherein the control assembly is operably coupled to the latch pin and the azimuth pin such that the remote control assembly simultaneously secures the device in the deployed position and unlocks the rotation of the device about the azimuth axis.

14. The system of claim 12, wherein the control assembly is operably coupled to the latch pin and the azimuth pin such that the remote control assembly simultaneously releases the device from the deployed position and locks rotation of the device about the azimuth axis.

15. The system of claim 12, wherein the device is rotatable about a deployment axis between the stowed position and the deployed position.

16. The system of claim 12, wherein the latch assembly comprises a hard stop configured to interface with an device latching feature and establish the deployed position of the device.

17. The system of claim 12, wherein the control assembly is mechanically coupled to the latch pin and the azimuth pin.

18. The system of claim 12, wherein the control assembly comprises a lever configured to cause movement of the latch pin and the azimuth pin.

19. The system of claim 18, wherein the lever causes movement of a yoke coupled to the latch pin and the azimuth pin.

20. The system of claim 19, wherein the yoke mechanically moves the latch pin via a push-pull cable.

21. A method for facilitating use of a deployable device, comprising:

providing a latch assembly having a latch pin movable to alternately secure an device in, and release the device from, a deployed position;

providing an azimuth pin movable to alternately lock and unlock rotation of the device about an azimuth axis; and facilitating operation of the latch pin and the azimuth pin, wherein the device is secured/released in/from the deployed position and rotation of the device about the azimuth axis is locked/unlocked, wherein facilitating operation of the latch pin and the azimuth pin further comprises operably coupling a control assembly to the latch pin and the azimuth pin.

22. The method of claim 21, wherein facilitating operation of the latch pin and the azimuth pin further comprises facilitating simultaneous operation of the latch pin and the azimuth pin, wherein the device is secured/released in/from the deployed position simultaneous with locking/unlocking of the rotation of the device about the azimuth axis.

23. The method of claim 21, wherein the control assembly comprises a lever operably coupled to a yoke, wherein the yoke mechanically moves the azimuth pin and is coupled to a push-pull cable to mechanically move the latch pin.

* * * * *